US005295757A

United States Patent [19]

Ivey et al.

[11] Patent Number: 5,295,757

[45] Date of Patent: * Mar. 22, 1994

[54] SAFETY END BARRIER FOR CONCRETE ROAD BARRIERS

[75] Inventors: Don L. Ivey; Hayes E. Ross, Jr., both of Bryan; W. Lynn Beason, College Station, all of Tex.

[73] Assignee: The Texas A&M University System, College Station, Tex.

[ * ] Notice: The portion of the term of this patent subsequent to Oct. 20, 2009 has been disclaimed.

[21] Appl. No.: 919,023

[22] Filed: Jul. 23, 1992

Related U.S. Application Data

[63] Continuation-in-part of Ser. No. 691,392, Apr. 2, 1991, Pat. No. 5,156,485.

[51] Int. Cl.[5] ..... E01F 13/00

[52] U.S. Cl. ..... 404/6; 256/13.1

[58] Field of Search ..... 404/6; 256/1, 13.1

[56] References Cited

U.S. PATENT DOCUMENTS

| | | | |
|---|---|---|---|
| 3,643,924 | 2/1972 | Fitch | 256/13.1 |
| 3,674,115 | 7/1972 | Young et al. | 188/1 B |
| 3,845,936 | 11/1974 | Boedecker, Jr. | 256/1 |
| 3,944,187 | 3/1976 | Walker | 256/13.1 |
| 3,982,734 | 9/1976 | Walker | 256/13.1 |
| 4,066,244 | 1/1978 | Yoho | 256/1 |
| 4,198,036 | 4/1980 | O'Neal | 267/140 |
| 4,307,973 | 12/1981 | Glaesener | 404/6 |
| 4,348,133 | 9/1982 | Trent et al. | 404/6 |
| 4,407,484 | 10/1983 | Meinzer | 256/13.1 |
| 4,605,336 | 8/1986 | Slaw, Sr. | 404/6 |
| 4,661,010 | 4/1987 | Almer et al. | 404/6 |
| 4,815,565 | 3/1989 | Sicking et al. | 188/32 |
| 4,822,208 | 4/1989 | Ivey | 404/6 |
| 4,971,475 | 11/1990 | Castonguay et al. | 404/6 X |
| 5,007,763 | 4/1991 | Burgett | 404/6 |

OTHER PUBLICATIONS

Ivey, et al., Portable Concrete Median Barrier: Structural Design and Dynamic Performance, Transportation Research Record No. 769, (1980), at pp. 20–30.

Bronstad and Kimball, Temporary Barriers used in Construction Zones, (Dec. 1977), (D.O.T. No.: DOT-FH-11-8130).

*Primary Examiner*—William P. Neuder

*Attorney, Agent, or Firm*—Arnold, White & Durkee

[57] ABSTRACT

A safety end barrier for use in coordination with roadside barriers. The safety end barrier lies substantially parallel to the direction of traffic flow and increases in height from about natural ground level at its lower end. The end barrier has sidewalls which angle upwardly outward from the barrier base. The taller end of the end barrier is preferably connected to a concrete roadside barrier through apertures extending from a recessed trough to the end of the safety end barrier. Preferably, bolts with two threaded ends, insertable through the apertures and secured by corresponding nuts, are used as connecting devices to connect the end barrier to a concrete roadside barrier.

20 Claims, 2 Drawing Sheets

SAFETY END BARRIER FOR CONCRETE ROAD BARRIERS

This application is a continuation-in-part of patent application 07/691,392 filed Apr. 2, 1991, which is incorporated herein by reference.

BACKGROUND OF THE INVENTION

1. Field of the Invention

The present invention generally relates to a new and improved end treatment for roadside barriers. The invention is especially suited for use with a barrier which is commonly referred to as a "low profile road barrier." The end treatment features sidewalls which angle outwardly from its base so as to reduce ramp and roll tendencies of vehicles impacting on it from the side.

2. Description of the Prior Art

Along most highways, there are hazards that present substantial danger to drivers of automobiles if they should happen to leave the highway. To help prevent such accidents, road barriers are often provided along the sides and in the median of a highway to channel the vehicles into appropriate lanes.

The use of road barriers has several important purposes. First, as noted above, the barriers are intended to channel vehicles hitting the barriers back into the adjacent traffic lanes. Second, the barriers are intended to help prevent vehicles from traveling entirely off the road or into the lanes of opposing traffic.

The common types of roadside barriers are structural concrete barriers and guardrail barriers. A typical structural concrete barrier is the "CMB" barrier which is about two feet wide at its base and tapers inwardly to a height of about 32 inches. The barrier at its top is typically about 6 inches wide. The guardrail barrier typically consists of treated wood posts placed periodically in the ground in an upright position with sections of corrugated metal connected horizontally to the posts.

Another type of roadside barrier is the low profile concrete road barrier described in application 07/691,392 filed Apr. 2, 1991, which has been incorporated herein by reference. The low profile concrete road barrier is typically comprised of one or more segments of structural reinforced concrete which measure no more than about 24 inches in height, and haveuter sidewalls facing the road which angle outwardly from the barrier base. The upwardly outward angle of the sidewall helps to make vehicle collisions with the barrier safer by reducing deflection off the barrier. The angle also reduces the rolling and ramping of vehicles impacting the barrier by tending to redirect the vehicles back onto the roadway and prevent such vehicles from mounting the curb.

End treatments are used generally on various roadside structures for safety purposes. One type of end treatment provides a gradual slope at the end of a roadside structure. This gradual slope helps to prevent head-on collisions by automobiles into the end of the structure. The gradual slope allows the automobile to move up on the structure which is a safer alternative than a head-on collision. Sloping end treatments are most commonly used in conjunction with guardrails, concrete barriers and drainage structures along roadways.

Another type of end treatment used in conjunction with a guardrail or concrete barrier usually consists of simply tapering the height of the rail or barrier downwards until it matches the existing natural ground elevation. The end treatment, when used with drainage structures, usually consists of reinforced concrete which is formed around the sloped-end of a pipe or culvert.

Neither of these two end treatments, however, is especially suitable for use in conjunction with the previously described low profile concrete road barrier. Moreover, both of the end treatments suffer from the same shortcomings as the conventional guardrail and CMB barriers.

SUMMARY OF THE INVENTION

The present invention in a broad aspect comprises a concrete barrier for use alongside a traffic lane or roadway. The invention more particularly comprises a barrier for use as an end treatment for a concrete roadside barrier. The invention is especially suited and intended for use with the low profile barrier mentioned earlier. The invention is particularly concerned with handling vehicles which would otherwise impact the blunt end of a roadside barrier; but it is also useful in handling vehicles which would otherwise tend to climb or veer along the side of a roadside barrier.

The invention in a broad context comprises an elongated, concrete structure which increases in height from its upstream end to its downstream end. The structure also preferably increases in width from its upstream end to its downstream end. Reinforced structural concrete may be used to provide a durable structure. The structure has a sidewall facing a traffic lane or roadway which tapers or slants outwardly and upwardly from the base of the structure. Preferably, both sidewalls are tapered in this manner such that the structure in vertical, transverse section resembles an inverted trapezoid.

The upstream end of the barrier of the invention is preferably low enough to pass under oncoming vehicles between their front wheels, and the downstream end is preferably about the same height as the roadside barrier which the barrier of the invention adjoins. Preferably, the upstream end of the roadside barrier and the downstream end of the barrier of the invention are coupled together to form a continuous structure. Both barriers are also preferably designed to be anchored to the ground.

As stated earlier, the barrier end treatment structures of the invention are preferably employed with the so-called low profile roadside barrier. As such, the present end treatment structure preferably terminates downstream in a structure profile which matches the profile of the low profile barrier. Thus, the downstream end is typically between about 12 and about 24 inches high and especially between about 16 and about 24 inches high. A particularly preferred height is 20 inches. The downstream end is also preferably about 20 to about 30 inches wide at its top and bottom, and from about 15 to 25 feet long. The sides of the structure taper outwardly from the bottom of the structure at an angle between about 60 degrees and about 89 degrees from the transverse axis of the structure, preferably between about 87 and about 88 degrees.

The width of the structure at its upstream end should be substantially less than the distance between the front wheels of highway vehicles, and preferably between about 12 and 16 inches. An especially preferred width is about 14 inches. The height at the upstream end should be sufficient to resist wear and tear and provide a durable structure. Thus, a height of about four inches is generally preferred.

Exemplary means for securing the end treatment barrier to the surface are also discussed.

DETAILED DESCRIPTION OF PREFERRED EMBODIMENT

Figure 1:
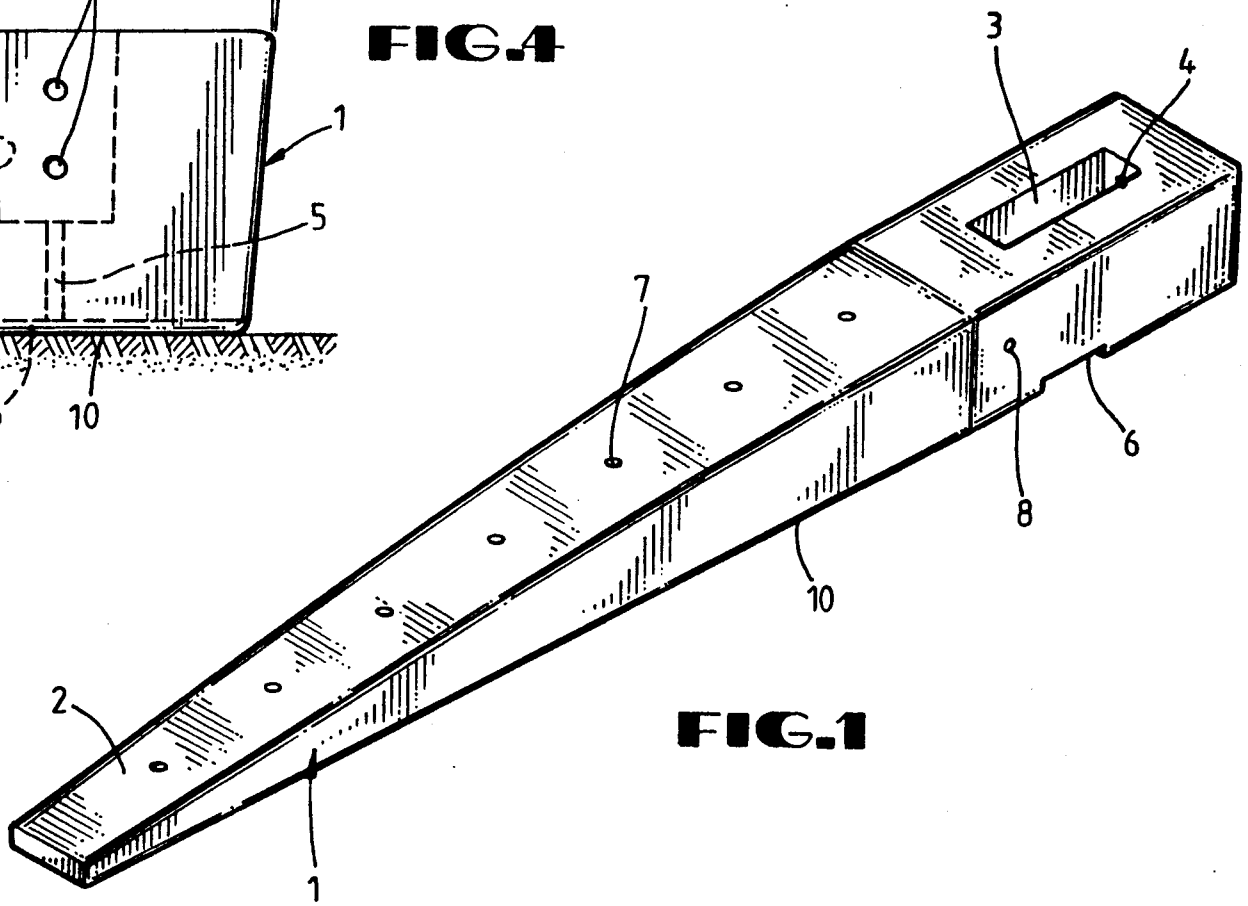
FIG. 1 is a perspective view of a preferred embodiment of the present invention.
Figure 2:
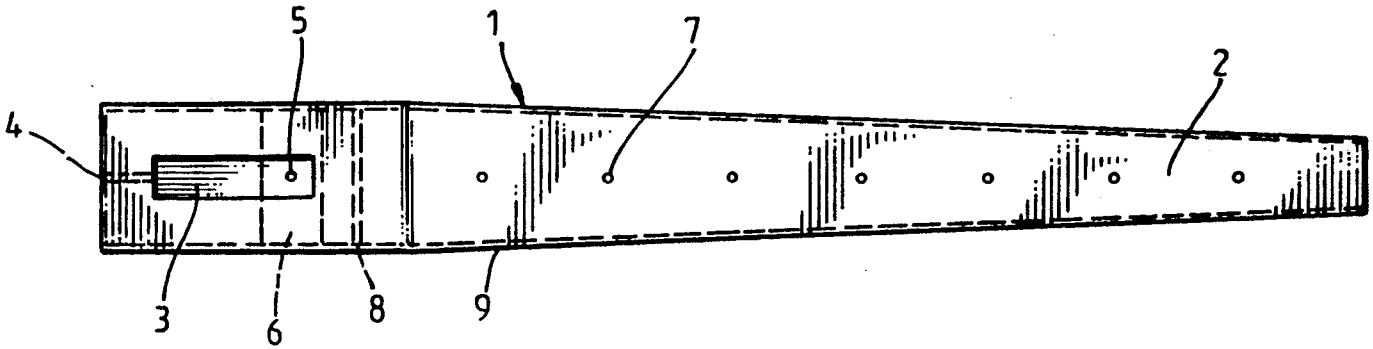
FIG. 2 is a plan view of a preferred embodiment of the present invention.
Figure 3:
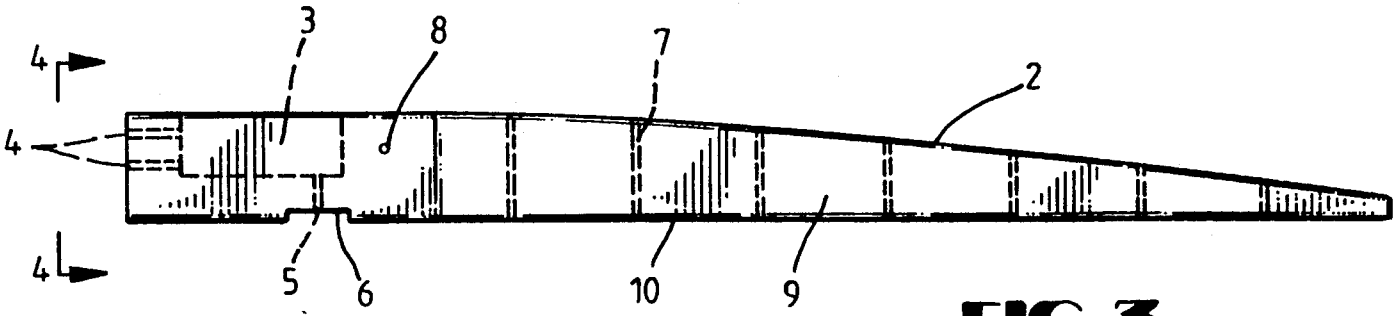
FIG. 3 is an elevation view of a preferred embodiment of the present invention.

A preferred embodiment of the present invention is depicted by FIGS. 1, 2, and 3. The end treatment barrier is comprised of concrete with conventional steel reinforcing. The downstream end of the end treatment barrier is provided with a trough or recess 3. The trough contains two apertures 4 within its endwalls which allow two bolts to be inserted to connect the end treatment barrier to the low profile barrier. Water caught in the trough 3 may drain through weep hole 5 and allowed to escape under the end treatment barrier through recessed drainage slot 6.

Figure 4:
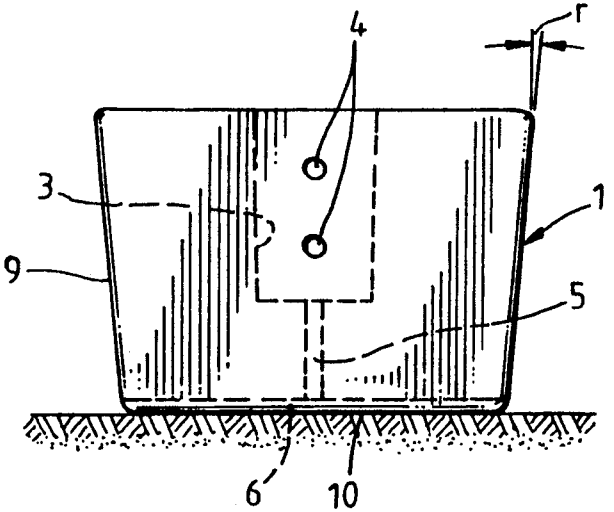
FIG. 4 is a cross-sectional view of the connecting end of a preferred embodiment of the present invention.

As shown in FIG. 4, the end treatment barrier rests on a surface such as a roadway shoulder along its base 10. A barrier may be merely set on the ground or secured in place through the use of steel rods or dowels placed through the end barrier through a series of apertures 7. One inch diameter steel rods have been found to suitably secure the barrier to the surface.

End treatment barriers may also be constructed by casting concrete in place along the designated roadway. Casting in place may be accomplished by using slip forms, steel forms or conventional wooden forms. As with the precast segments described above, these cast in place segments may either be affixed by dowels or steel rods, or merely rest on the surface. Additionally, through tie-ins of reinforcing steel, or use of a preformed groove or keyway, the cast in place end treatment barrier may be made permanently attached to the surface.

A precast end treatment barrier may be moved through the use of a pipe or rod placed in aperture 8. Typically, a pipe or steel rod of suitable size and strength may be placed through aperture 8 for aid in moving the end treatment barrier.

Sidewall 1, facing a traffic lane, is outwardly angled from base 10. In one embodiment, shown in FIG. 4, both end treatment barrier sidewalls 1 and 9 are angled outwardly from the base at angle r. Such an anle r tends to redirect a vehicle into the traffic lane and to hold the vehicle toward the ground.

The end treatment barrier may be connected to the low profile concrete barrier using alternative exemplary methods such as described in patent application 07/691,392 filed Apr. 2, 1991, which has been incorporated by reference herein.

The structural concrete used in the invention may typically have conventional compressive strengths of about 2,000 to 6,000 psi and more typically between about 3,000 and 5,000 psi after 28 days of curing. The concrete segments may also be advantageously formed of concrete, pre-stressed with steel cables in accordance with conventional methods.

The outward angling of at least one sidewall 1 of the end treatment barrier has an added benefit in simplifying the process for making concrete barriers, which are generally pre-formed. Conventional end barriers having upwardly inward sloping walls require their forms to be overturned; whereas the end treatment barriers of this invention may simply be lifted out of their forms.

The safety end treatment barrier top surface 2 increases in height from about ground level at its upstream end to its downstream end, therefore increasing along its length in the same direction as the flow of traffic. The downstream end is typically between about 12 and about 24 inches high and especially between about 16 and about 24 inches high. A particularly preferred height is 20 inches. The increase in height may occur either in a constant straight slope along the length of top surface 2 or in an outward curve, preferably such that the convex side of the curve faces upward. As noted earlier, the upstream end preferably has a starting height for top surface 2 of about four inches, i.e., low enough to clear beneath vehicles, but high enough for structural stability.

Lengths suitable for end treatment barriers of the invention are variable, but the length is preferably between about 5 and about 30 feet and most preferably between 15 and 25 feet. The suitability of any given length will depend on several factors, including the contractor's preferences and the geometry of the road.

The end treatment barrier width may also vary. The top and base may each measure from about 20 inches to about 30 inches in width as required to be approximately match the widths and profiles of the corresponding roadside barrier which the end treatment barrier adjoins. If less than 20 inches wide, the end treatment barriers should be bolted or otherwise permanently affixed to the ground. The top should always be wider than the bottom as explained earlier.

The outer sidewalls of each end treatment barrier should be disposed at an angle of between about 60 and about 89 degrees from the transverse axis of the barrier base. This angle is preferably between about 80 and about 88 degrees, and especially between about 87 and about 88 degrees. The steeper angles, among other factors, provide for greater mass.

A specific example of a barrier of the invention is about 20 feet long, and is about 20 inches high at its downstream end and about 4 inches high at its upstream end. The exemplary barrier is also about 14 inches wide at its upstream end and have downstream widths of about 28 inches (at the base) and about 26 inches (at the top).

Many variations and modifications may be made to the end treatment barrier described herein without departing from the relevant principles of the invention. For example, the end treatment barriers of this invention may be combined with other types of road barriers and guard rails. The barriers may also be assembled in segments, coupled end-to-end as by means of the apertures, recesses and bolts described earlier. In such event, at least some of the segments have apertures and recesses, or other suitable coupling provisions at each end. The tapers in the width and the height of the barriers need not be continuous from one extreme end to the other. Thus, as shown in the drawing, the tapers may end as they near the downstream end of the barriers. The angle or slant of the sidewalls may also vary along the length of the barriers but should remain within the angles described earlier. Accordingly, it should be readily understood by persons skilled in the art that the scope of this invention is not limited to the specific applications provided in this disclosure but is intended to encompass any embodiment that falls within the scope and spirit of the appended claims.

I claim:

1. A safety end treatment barrier for use alongside a traffic lane, which comprises:

an elongated concrete member which increases to a height of between about 12 and about 24 inches along its length and in the same direction as the flow of traffic alongside the member; said member including a base, and a sidewall facing the traffic lane which slants outwardly from the base.

2. The safety end treatment barrier of claim 1, wherein the elongated concrete member increases to a height of between 16 and about 24 inches along its length and in the same direction as the flow of traffic alongside the member.

3. The safety end treatment barrier of claim 1, wherein the an elongated concrete member increases to a height of approximately 20 inches along its length and in the same direction as the flow of traffic alongside the member.

4. The barrier of claim 1, wherein said sidewall angles outwardly from the base at an angle of between about 60 and about 89 degrees relative to the base.

5. The barrier of claim 2, wherein said sidewall angles outwardly from the base at an angle of between about 60 and about 89 degrees relative to the base.

6. The barrier of claim 3, wherein said sidewall angles outwardly from the base at an angle of between about 60 and about 89 degrees relative to the base.

7. The barrier of claim 1, wherein said sidewall angles outwardly from the base at an angle of between about 80 and about 88 degrees relative to the base.

8. The barrier of claim 2, wherein said sidewall angles outwardly from the base at an angle of between about 80 and about 88 degrees relative to the base.

9. The barrier of claim 3, wherein said sidewall angles outwardly from the base at an angle of between about 80 and about 88 degrees relative to the base.

10. The barrier of claim 1, wherein said sidewall angles outwardly from the base at an angle of between about 80 and about 88 degrees relative to the base.

11. The barrier of claim 2, wherein said sidewall angles outwardly from the base at an angle of between about 87 and about 88 degrees relative to the base.

12. The barrier of claim 3, wherein said sidewall angles outwardly from the base at an angle of between about 87 and about 88 degrees relative to the base.

13. The barrier of claim 1, in which the higher end portion contains a recess and at least one aperture extending between the recess and the end of the barrier; said recess and each said aperture configured to enable a connector to be inserted through each aperture via the recess.

14. The barrier of claim 2, in which the higher end portion contains a recess and at least one aperture extending between the recess and the end of the barrier; said recess and each said aperture configured to enable a connector to be inserted through each aperture via the recess.

15. The barrier of claim 3, in which the higher end portion contains a recess and at least one aperture extending between the recess and the end of the barrier; said recess and each said aperture configured to enable a connector to be inserted through each aperture via the recess.

16. The barrier of claim 13, further comprising a connector extending through each said aperture to interconnect the end barrier with an abutting roadside concrete barrier.

17. The barrier of claim 14, further comprising a connector extending through each said aperture to interconnect the end barrier with an abutting roadside concrete barrier.

18. The barrier of claim 15, further comprising a connector extending through each said aperture to interconnect the end barrier with an abutting roadside concrete barrier.

19. A safety end treatment barrier for use alongside a traffic lane, which comprises: an elongated concrete member which:

(a) increases in height along its length from a traffic upstream height sufficient to render the member durable but low enough to clear below vehicles to a downstream height of between about 12 and about 24 inches;

(b) increases in width along its length from a traffic upstream width sufficient to render the member durable but less than the lateral distance between the wheels of a vehicle a downstream width of between about 20 and about 30 inches; and (c) has a sidewall facing a traffic lane which plants upwardly and outwardly at an angle between about 60 and about 89 degrees relative to transverse a six of the member.

20. The barrier of claim 19 which has an upstream height of about 4 inches, a downstream height of about 20 inches, an upstream width of about 14 inches, a downstream width of between about 20 and about 30 inches, and at a sidewall facing a traffic lane which slants upwardly and outwardly at an angle between about 80 and about 88 degrees relative to the transverse axis of the member.

* * * * *

UNITED STATES PATENT AND TRADEMARK OFFICE

CERTIFICATE OF CORRECTION

PATENT NO. : 5,295,757

DATED : MARCH 22, 1994

INVENTOR(S) : IVEY/ROSS/BEASON

It is certified that error appears in the above-indentified patent and that said Letters Patent is hereby corrected as shown below:

In column 1, line 4, please delete "April 2" and insert therefor --April 25--.

In claim 10, line 3, please delete "80" and insert therefor --87--.

Signed and Sealed this

Thirtieth Day of August, 1994

*Attest:*

*Attesting Officer*

BRUCE LEHMAN

*Commissioner of Patents and Trademarks*